US007508951B2

(12) United States Patent
Bordewijk

(10) Patent No.: US 7,508,951 B2
(45) Date of Patent: Mar. 24, 2009

(54) HEARING AID WITH PULL CORD

(75) Inventor: Lourens George Bordewijk, Av Den Haag (NL)

(73) Assignee: Audilux Science B.V., Av Den Haag (NL)

( * ) Notice: Subject to any disclaimer, the term of this patent is extended or adjusted under 35 U.S.C. 154(b) by 464 days.

(21) Appl. No.: 10/530,327

(22) PCT Filed: Oct. 3, 2003

(86) PCT No.: PCT/NL03/00677

§ 371 (c)(1),
(2), (4) Date: Feb. 24, 2006

(87) PCT Pub. No.: WO2004/032565

PCT Pub. Date: Apr. 15, 2004

(65) Prior Publication Data

US 2007/0019832 A1 Jan. 25, 2007

(30) Foreign Application Priority Data

Oct. 5, 2002 (NL) ..... 1021588

(51) Int. Cl.
*H04R 25/00* (2006.01)

(52) U.S. Cl. ..... 381/329; 381/328; 381/322

(58) Field of Classification Search ..... 381/322, 381/324, 328, 380, 382, 329; 181/130, 135
See application file for complete search history.

(56) References Cited

U.S. PATENT DOCUMENTS

| | | | | |
|---|---|---|---|---|
| 4,869,339 | A * | 9/1989 | Barton | 181/130 |
| 5,748,743 | A * | 5/1998 | Weeks | 381/328 |
| 6,529,609 | B1 * | 3/2003 | Neilson et al. | 381/329 |
| 6,546,108 | B1 * | 4/2003 | Shennib et al. | 381/322 |
| 2001/0042708 | A1 | 11/2001 | Brimhall | |

* cited by examiner

*Primary Examiner*—Curtis Kuntz
*Assistant Examiner*—Ryan C Robinson
(74) *Attorney, Agent, or Firm*—Sughrue Mion, PLLC

(57) ABSTRACT

Hearing aid comprising two parts that can be joined together/taken apart. One part is provided with the electronics and preferably consists of a universal part. The other part comprises an accommodation for the battery and is matched to the wearer's auditory canal. Both parts are provided with a pull cord for removing from the ear and separating the parts from one another. These pull cords are preferably in contact with one another.

9 Claims, 2 Drawing Sheets

HEARING AID WITH PULL CORD

CROSS REFERENCE TO RELATED APPLICATIONS

This application is a national stage entry of PCT Application PCT/NL2003/0006, which claims foreign priority from the Netherlands Patent Application 2002-1021588

BACKGROUND OF RELATED ART

These hearing aids are also termed CIC (completely-in-the-canal) aids and are marketed under the trade name Microlux by Audilux N. V. in The Hague.

Hearing aids of this type consist of two parts. In a particular variant the first part is provided with the electronics and the second part is mainly an accommodation for a battery. Moreover, one of the parts is preferably of universal construction and the other part is matched to the auditory canal of the wearer.

Under all circumstances it must be possible to remove the hearing aid from the ear. Moreover, it must be possible to separate the two parts, for example to replace/charge the battery or to perform other activities. Separation of the two parts is also necessary for cleaning, for example the removal of earwax.

It is known to provide such a hearing aid with a single pull cord that is permanently attached. This protrudes from the auditory canal to only a slight extent and the wearer can remove the hearing aid by pulling. As indicated, under some circumstances it can be necessary to separate the two parts from one another after removal from the ear. A wide variety of methods are used for this purpose in the state of the art. Pushing a rod or the like through the second part, as a result of which the first part is detached from the second part, may be mentioned as an example. Other methods are also known, but these all have in common that uncontrolled, and possibly high, forces are applied to the parts, as a result of which damage regularly occurs.

BRIEF SUMMARY OF THE INVENTION

The present invention relates to a hearing aid comprising two parts that can be joined together/taken apart, as well as a pull cord for removing said hearing aid from the auditory canal.

More particularly, the present invention relates to hearing aids that are fitted deep in the auditory canal.

The aim of the present invention is to avoid the disadvantages described above.

This aim is realised with a hearing aid as described above in that each of said parts is provided with a pull cord attached thereto.

According to the present invention each part is provided with a pull cord. By this means it is possible to separate the parts from one another after removing from the ear. Moreover, the presence of two pull cords provides the wearer with (psychological) assurance that should one of the cords break it is still easily possible to remove the aid from the ear.

According to an advantageous embodiment, the two parts can be fitted in only one position with respect to one another. In order to make the pull cords as invisible as possible to the outside world, in such an embodiment provision is made that the pull cords are arranged lying on top of one another. Apart from the fact that the pull cords are less visible, this has the advantage that when grasped by the wearer the two pull cords are automatically pressed against one another and the pull force exerted by the wearer is distributed uniformly over the pull cords.

As described above, the first part preferably contains the electronics, comprising microphone, loudspeaker and the like. This part is preferably of universal construction.

The second part is preferably matched to the wearer's auditory canal. This can be achieved by providing one or more standard covers that are capable of being coupled to the first part. Such a coupling preferably comprises sliding into one another, the cover being on the outside. Preferably, that cover that is smaller than the user's auditory canal is chosen from these standard covers. Material is then applied to the cover by injection and/or bonding techniques, as a result of which the appearance of the second part obtained in this way precisely corresponds to the shape of the wearer's auditory canal.

It will be understood that the method for obtaining the second part is not essential for the use of the two pull cords according to the present invention.

The pull cords are preferably so made that these are not conspicuous. That is to say, they can have a colour that corresponds to the body colour or can be made transparent. The pull cord preferably consists of a very strong material, such as a nylon material. It can be provided with profiling to give better grip. It is also possible to make the pull cord integral with one of the parts.

According to a further advantageous embodiment, the hearing aid is not circular. More particularly, there is a clear preferred position for fitting in the auditory canal. In such preferred position provision is made that the pull cords are arranged on the side of the wearer's face. That is to say, the pull cords are arranged in the shadow of the aid itself and of the tragus. The pull cords are least conspicuous in this position. In addition, the first part and the cover that forms the base for the second part can still be universal. Even if, for example, the first part is curved to some extent in the direction of the longitudinal axis of the auditory canal, which is desirable in practice in order to provide an optimum fit, positioning on the face side will still be possible in the case of left/right fitting.

BRIEF DESCRIPTION OF THE DRAWINGS

The invention will be explained in more detail below with reference to an illustrative embodiment shown in the drawing. In the drawing.

DETAILED DESCRIPTION OF THE EXEMPLARY EMBODIMENTS

Figure 1:
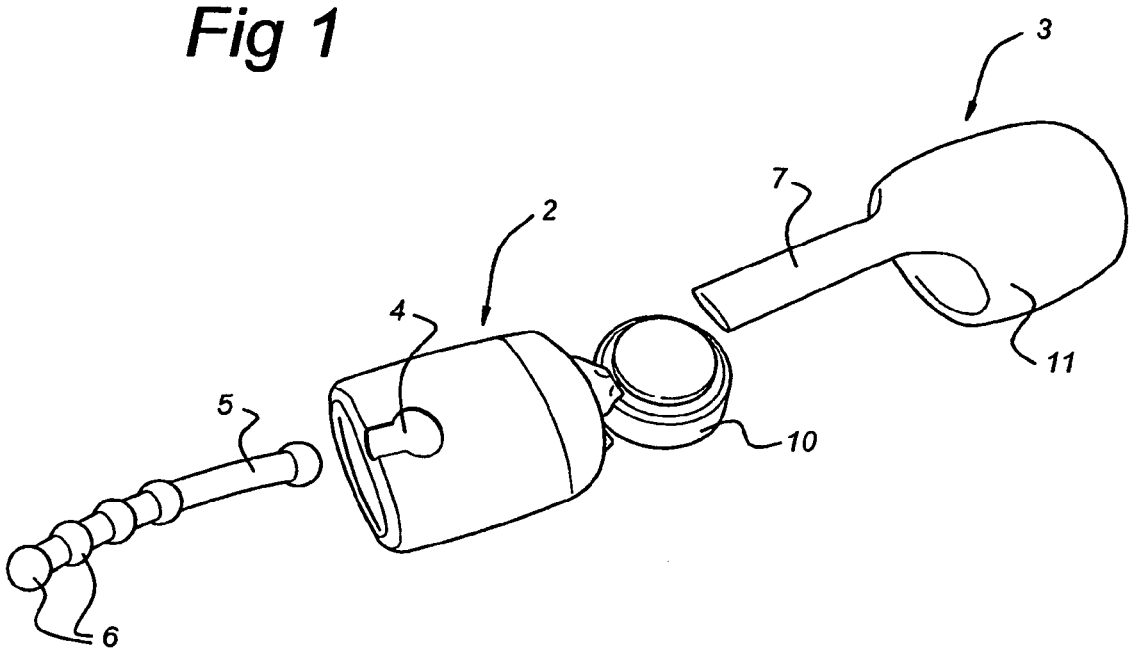
FIG. 1 shows the various components from which the hearing aid according to the invention is constructed.
Figure 2:
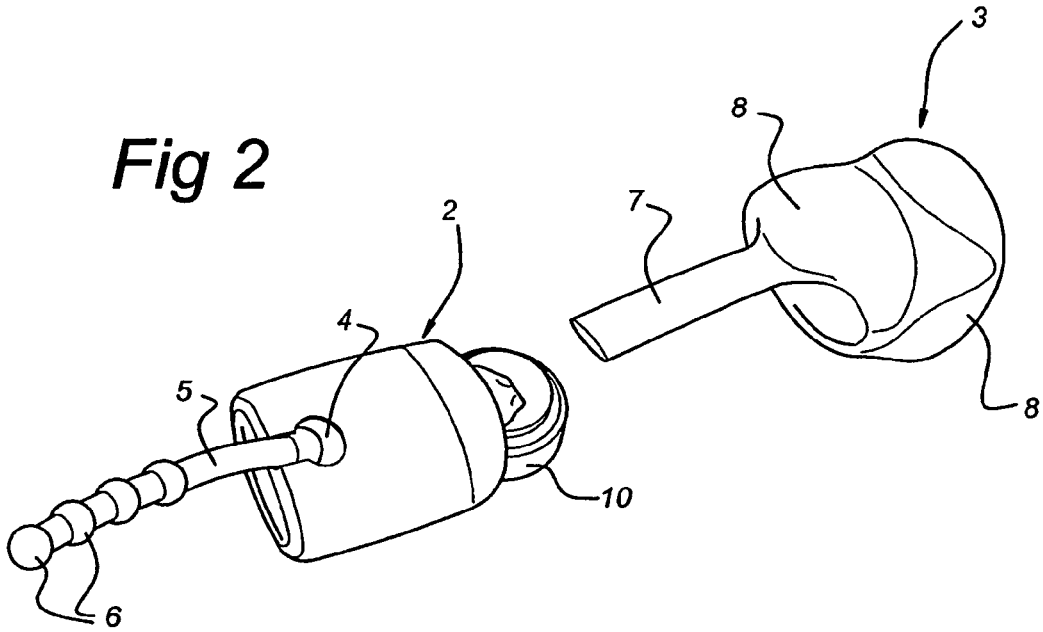
FIG. 2 shows the two parts of the hearing aid according to the invention before joining together.
Figure 3:
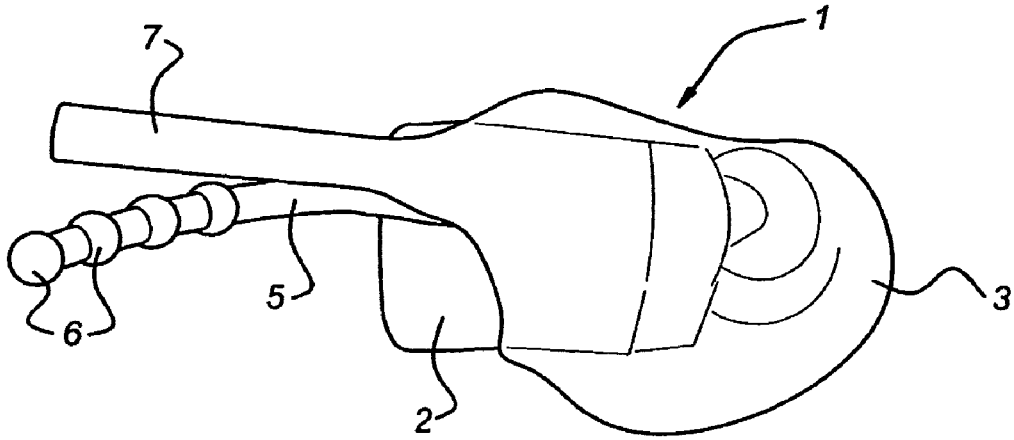
FIG. 3 shows the hearing aid when joined together.

In FIG. 3 the hearing aid according to the invention is indicated in its entirety by 1. As can be seen from FIGS. 1 and 2, this hearing aid consists of two parts, a first part 2 and a second part 3. The first part 2 is a preferably universal part and is provided with electronics. These are understood to be a microphone, amplifier and loudspeaker. Furthermore, there are terminals or the like, which are not shown in more detail, for accommodating a battery 10. There can also be on/off switches, controls, links to programming computers and the like. For details reference is made to other patents/applications filed in the name of Audilux. Part 2 is made somewhat curved in the longitudinal direction thereof in order to provide an optimum match to the auditory canal. There is a keyhole-shaped channel 4 in the first part 2. This is made to accommodate a pull cord 5, which is provided with thickenings 6. This pull cord 5 preferably consists of a transparent material of high strength, such as nylon material. One example is nylon 5 or 6. The end thickening of the pull cord 5 fits precisely in the widened part of the accommodation and the relevant parts can then be fixed by bonding.

The second part 3 comprises, as supplied by the manufacturer, a cover 11 with a pull cord 7 attached integrally thereto.

Covers 11 of various sizes or customised covers 11 can be made available. Thickenings 8 are then made on these covers 11, as can be seen from FIG. 2. This can take place using bonding techniques or using injection techniques. One example therefor is described in PCT application PCT/NL/02/00100 in the name of Audilux.

The cover 11, or the second part 3, is so constructed that this can be pushed over the first part 2 only in one position. This is shown in FIG. 3, from which it can be seen that the pull cords 5 and 7 are arranged in contact with one another.

Figure 4:
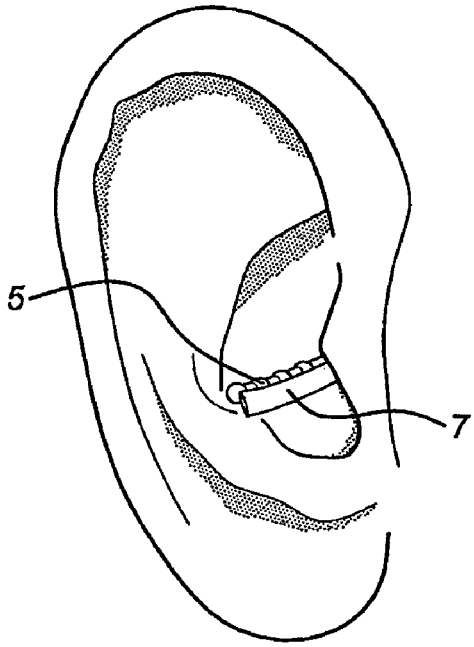
FIG. 4 shows the positioning of the pull cords according to the invention with respect to the ear.

The right ear of a wearer is shown diagrammatically in FIG. 4. When the hearing aid 1 according to the present invention is fitted in the ear, this hearing aid is invisible. Only the pull cords 5 and 7 protrude. As can be seen from FIG. 4, these are on the face side, on the right in the "three o'clock position" and on the left in the "nine o'clock position". It is possible to achieve the same effect on the wearer's left side with the aid of the same universal part 2 and an adapted cover 11.

If the hearing aid has to be removed from the ear, the user presses the two pull cords 5 and 7 together using his or her fingers and then exerts force. During this operation the profiling 6 presses against the pull cord 7, as a result of which maximum grip and force distribution are provided. In this way the aid is removed from the ear with relatively little effort. If the user then wishes to separate parts 2 and 3 in order to change the battery, or for cleaning purposes, or for other reasons, he or she simply holds part 3 firmly and pulls on cord 5 to remove part 2 that has been pushed into part 3.

Although the invention has been described above with reference to a preferred embodiment, it will be understood by those skilled in the art that numerous modifications can be made which are immediately obvious and fall within the scope of the appended claims.

The invention claimed is:

1. Hearing aid comprising a first part and a second part that can be joined together/taken apart, as well as means for removing said hearing aid from the auditory canal, the means for removing said hearing aid comprising two pull cords, each of said parts being provided with one of said pull cords attached thereto, wherein said parts are fitted only in one position with respect to one another and wherein said pull cords are arranged at least partially in contact with one another in said position.

2. Hearing aid according to claim 1, wherein said parts comprise a first universal part provided with a microphone, electronics and loudspeaker.

3. Hearing aid according to claim 1, wherein said parts comprise a second part that has been matched to the user's auditory canal and is designed to accommodate a battery.

4. Hearing aid according to claim 1, wherein said parts can be slid into one another.

5. Hearing aid according to claim 1, wherein a pull cord is provided with profiling.

6. Hearing aid according to claim 1, wherein a pull cord is essentially smooth.

7. Hearing aid according to claim 1, wherein a pull cord comprises a nylon material.

8. Hearing aid according to one of the receding claims, wherein one of said pull cord comprises a separate part provided with a thickened end, accommodated in a recess in one of said two parts.

9. Hearing aid according to claim 1, wherein said parts are of non-circular construction such that when fitted in the auditory canal one of said pull cords is on a face side of the auditory canal.

* * * * *